US005505872A

United States Patent [19]

Krulik et al.

[11] Patent Number: 5,505,872

[45] Date of Patent: Apr. 9, 1996

[54] SOLDER STRIPPER RECYCLE AND REUSE

[75] Inventors: Gerald A. Krulik, San Clemente, Calif.; Nenad V. Mandich, Homewood, Ill.; Rajwant Singh, Fullerton, Calif.

[73] Assignee: Applied Electroless Concepts, Inc., San Clemente, Calif.

[21] Appl. No.: 447,811

[22] Filed: May 23, 1995

[51] Int. Cl.[6] ..... C09K 13/04

[52] U.S. Cl. ..... 252/79.2; 252/79.1; 252/79.4; 216/93; 216/106; 216/108

[58] Field of Search ..... 252/79.1, 79.2, 252/79.3, 79.4; 134/3, 41; 156/656, 664

[56] References Cited

U.S. PATENT DOCUMENTS

| | | | |
|---|---|---|---|
| 4,112,191 | 9/1978 | Anderson | 428/497 |
| 4,673,521 | 6/1987 | Sullivan et al. | 252/79.3 |
| 4,713,144 | 12/1987 | Schiller | 156/656 |
| 4,921,571 | 5/1990 | Kukanskis et al. | 156/656 |
| 4,957,653 | 9/1990 | Cordani | 252/79.2 |
| 5,219,484 | 6/1993 | Krulik | 252/79.2 |
| 5,244,539 | 9/1993 | McGrath et al. | 156/656 |

*Primary Examiner*—Hoa Van Le

[57] ABSTRACT

This invention relates to the removal of lead from spent ferric nitrate based solder strippers, the regeneration of the spent ferric nitrate based solder strippers, and the reuse of these solutions at least one time. It comprises a method and process for precipitating lead salts from used acidic solder strippers which are employed to strip solder coatings, including the underlying tin-copper alloy, from the copper substrate of a printed circuit board. The method includes the use of sulfate ions which are directly added to an aqueous solution of spent solder stripper, without neutralization of the spent solder stripper, optionally in combination with nitric or methylsulfonic acid addition. After precipitation and removal of the lead salts, additional components of the solder stripper composition may be added to substantially restore the initial functioning of the solder stripper.

11 Claims, No Drawings

SOLDER STRIPPER RECYCLE AND REUSE

BACKGROUND OF THE INVENTION

1. Field of the Invention

This invention relates to the removal of lead from spent nitrate based solder strippers, the regeneration of the spent nitrate based solder strippers, and their reuse.

2. Background and Prior Art

A typical printed circuit board uses a copper conductor attached to an insulating support, in a patterned manner. Tin/lead solder is applied onto the copper conductor, typically by electroplating before the copper conductor becomes patterned into the final electrical circuit. The solder film is nominally 0.0003 inches thick which is the standard thickness used in most present day processes. The actual thickness may vary considerably over the board and from board to board, as in any manufacturing process. Once solder is applied to the copper, a thin film of copper-tin alloy forms by solid state diffusion between the copper and solder. This copper-tin alloy film increases in thickness with time, but is typically about 0.000002 to 0.000004 inches thick.

As used in this specification and claims, the word "solder" includes the various low melting point alloys and elements used for electrical soldered connections and for copper etching masks or resists. The majority of such coatings are of various compositions of tin-lead alloys, or are substantially pure tin, but can also include lead-free alloys, pure lead coatings, and alloys containing silver, bismuth, cadmium, indium, and other metals. Such films are produced by various methods, including electroplating, chemical deposition and immersion in a melt. This patent invention is directed specifically to solders containing more than about 5% of lead as one of the components.

When applied as a bulk film, the solder may be used as a resist over the copper during etching of the copper in the production of a solder mask over bare copper boards. During the manufacturing process the solder film is applied in an image-wise fashion to those areas which will be the final copper conductor. The uncoated copper is then etched from the insulating and supporting base by means of selective chemical etchants for the copper, such as ammoniacal cuptic chloride solution. The solder film is later stripped from the copper substrate to allow for final fabrication, assembly, and testing. In other applications, solder is used to join two or more electrical conductors together. This solder may be removed by solder strippers for more effective rework, during salvage of board components, and during treatment of scrap and recycle boards to remove lead to reduce environmental liabilities.

Two types of compositions have been generally used in the past for solder stripping. The most widely used prior compositions were based on mixtures of an acidic solution of hydrogen peroxide and fluoride, as described in U.S. Pat. No. 4,673,521 issued Jun. 16, 1987.

Acidic fluoride with peroxide solutions break down during both use and storage. They attack copper easily, leading to large amounts of soluble copper in addition to dissolved lead and tin. The fluoride content of the solutions leads to rapid attack of the fiberglass used as a component of the insulating substrate. This gives an additional toxic material, fluorosilicic acid, for waste treatment. Fluoride is both extremely toxic to the operators and difficult to effectively waste treat.

More recently, formulations based on methansulfonic acid, U.S. Pat. Nos. 4,921,571 and 4,957,653 issued Sep. 18, 1990; or nitric acid solution described under various U.S. patents including U.S. Pat. No. 5,219,484 issued Jun. 15, 1993 and U.S. Pat. No. 5,244,539 issued Sep. 14, 1993; both of which types contain ferric ion have become widely commercially used. This patent application specifically relates to the treatment of acidic solder strippers containing ferric nitrate.

Nitric acid based solutions eliminate many of the problems of fluoride based strippers. The earliest nitric acid strippers consisted of two sequential solutions, consisting of a nitric acid solution to dissolve the solder, followed by a second acidic solution containing ferric ions or other materials to remove the tin-copper alloy. The second solution may contain ferric chloride, ammonium persulfate, a mixture of hydrogen peroxide and sulfuric acid, or a conventional acidic hydrogen peroxide-fluoride mixture.

Ferric nitrate containing compositions for stripping lead based, lead-tin, and similar solders from printed circuit boards or solder masks are described in the following recently issued United States patents. The composition of U.S. Pat. No. 4,713,144 issued Dec. 15, 1987 is a combination of nitric, ferric and sulfamic acid which strips quickly but generates a large amount of tin rich sludge. Formulations containing organic acids such as those described in U.S. Pat. No. 5,219,484 issued Jun. 15, 1993, have been used to attempt to solve the sludge problem but have not been entirely satisfactory in that they only delayed the formation of sludge.

The composition described in U.S. Pat. No. 5,244,539 is a combination of nitric, ferric, and ammonium ions in combination with urea as a nitric acid fume suppressant and organic triazoles as copper antitarnish agents. This gives a low sludging solution but the urea reacts with nitric acid to give the heat-sensitive explosive urea nitrate which precipitates from the solution.

The basic composition and method for single bath and spray stripping is now well described in prior art patents such as those noted above. Commercialization of this process is dependent on meeting most of the following customer expectations: complete stripping in a reasonable minimum time, low attack rate on the exposed copper, a bright surface on the exposed copper which does not rapidly tarnish, long solution stripping life, little toxic fume evolution, and little or no sludge formation.

While effective ferric nitrate acid based strippers are now readily available, there is no effective waste treatment method which leads to the recycle and reuse of such solder strippers. The usual procedure is to treat the spent stripper with caustic to neutralize the solution and give a bulk precipitate of lead, copper, tin, and iron salts; then remove any remaining soluble lead or copper by use of diethyldithiocarbamate, sulfide, or other waste treatment compound. This method serves to waste treat the solder stripper only. None of these patents describes the regeneration of such compositions after they have been used, except U.S. Pat. No. 4,944,851 which uses electrolytic regeneration. U.S. Pat. No. 4,944,851 describes electrolytic methods for reclaim of solder only from used solder stripper solutions based on methylsulfonic acid. There are many disadvantages, including the need for a sealed three compartment plate-out cell, ion selective membrane separators, and electrolytic rectifiers. Nitrate must be excluded as it interferes with formation of a coherent film and the reduction of nitrate reduces the cathode efficiency. There is no available general method which can selectively remove lead from all ferric nitrate based solder strippers and allow the solder stripper to be effectively reused.

It is a principal object of the present invention to provide a new method for selective removal of lead from spent ferric nitrate based solder stripper, the addition of regeneration chemicals, and the reuse of the regenerated ferric nitrate based solder stripper one or more times. These and other objects, advantages, features and results will more fully appear in the course of the following description.

SUMMARY OF THE INVENTION

The present invention is directed to the removal of lead from spent ferric nitrate based solder strippers, the regeneration of the spent ferric nitrate based solder strippers, and the reuse of the regenerated ferric nitrate based solder strippers. This invention comprises the following sequence of steps:

1. Addition of a source of sulfate to said used stripper compositions, thereby precipitating dissolved lead from the same, 2. Separation of precipitated lead as sulfates and/or bisulfates, 3. Addition of a replenisher to reconstitute the stripper solution for reuse, 4. Reuse of the reconstituted stripper.

This invention is applicable to ferric nitrate solder strippers containing nitric acid, methylsulfonic acid, their combinations, and other acidic mixtures.

It is a particularly novel and unexpected feature of the invention to find that sulfate ions will precipitate large amounts of lead in the presence of large amounts of nitric and methylsulfonic acids. It was particularly unexpected to discover that the lead solubility decreases as the concentration of nitric acid or methylsulfonic acid decreases. Unless specifically noted in the following discussions, sulfate will refer to both sulfate and bisulfate ions. In practicing the method of this invention, it was found that lead bisulfate is substantially less soluble than lead sulfate. For example, when sulfuric acid is added to a low acidity solution, most of the sulfuric acid is dissociated completely to sulfate ions as follows:

$$H_2SO_4=H^++HSO_4^-$$

$$HSO_4^-=H^++SO_4^{2-}$$

The addition of a second acid, preferably a strong acid such as nitric acid or methylsulfonic acid, suppresses the total ionization of sulfuric acid as follows:

$$H_2SO_4+x\ H^+=(x+1)\ H^++HSO_4^-$$

This increases the concentration of bisulfate ion and decreases the solubility of lead by formation of more insoluble lead bisulfate.

Presumably the concentration of sulfuric acid itself could be increased to high levels, thus inhibiting the self-ionization of the sulfuric acid and leading to increased precipitation of lead bisulfate. In practice, this approach is not satisfactory. It has been found that the amount of free sulfate in a ferric nitrate based solder stripper needs to be kept to a minimal amount. Large excesses of sulfate reduce the rate of stripping of solder deposits and give bare copper surfaces of poor appearance. It is an advantage of this invention that the precipitation of lead salts can be promoted while minimizing the use of excess sulfate.

In practice, less than an equimolar amount of sulfate can be used to precipitate less than the full amount of lead sulfate. Preferably, at least a 0.5:1 to a 2:1 mole ratio of sulfate to lead is used for more complete lead removal. The case of the 2:1 ratio theoretically represents complete precipitation of lead bisulfate, $Pb(HSO_4)_2$. A ratio of up to 3:1 is useful, with up to 10:1 possible for most complete lead precipitation, for example, during final waste treatment when no further reuse is contemplated.

Another advantage of this process is also related to selective of the lead sulfate. Simple neutralization of spent solder stripper precipitates all metal salts, including the lead and iron. This mixture is not very attractive for reclaim due to the low concentration of lead. By removing the lead before complete neutralization, it is possible to separate a recyclable material from the bulk of the solder stripper. This also is advantageous in waste treatment, in that only a small amount of residual lead needs to be removed from the residual spent solder stripper.

The solder stripper can be regenerated after removal of the lead. Even though tin removal is not a specific aim of this process, tin often spontaneously precipitates as a variety of tin salts such as tin metastannate. Regardless, the remaining tin does not seem to inhibit stripping. Any regeneration solution added to the spent solder stripper after lead removal should contain whatever chemicals are needed to compensate for any soluble tin, such as increased amounts of copper anti-tarnish compounds or chlorides. Thus the regeneration solution is specific to the exact composition of the solder stripper being regenerated, but the lead removal function of sulfate seems to be general to all ferric nitrate based solder strippers.

In general terms, a solution used for solder stripper regeneration after lead removal using sulfates, will contain one or more of the following: a material selected from the group consisting of benzotriazole, carboxybenzotriazole, tolytriazole and their salts, and combinations thereof in an amount not more than about 5% by weight of the liquid, to give a bright copper surface; sulfamic acid, to suppress the evolution of toxic nitric oxide fumes during storage of the liquid and especially during use of the liquid for stripping; nitric or sulfamic acid, as applicable to compensate for losses during processing; a ferric ion source to compensate for losses of ferric nitrate during processing; a source of chloride ion, if used to help tin dissolution; and any other applicable compounds. It is even possible to make a regeneration solution which contains sulfate plus one or more of the above components, so lead precipitation and solution regeneration would occur simultaneously.

The total invention comprises a method of using sulfates or bisulfates to precipitate lead salts from spent ferric nitrate based solder strippers; the process of separating such lead salts and other insolubles from the spent solder stripper; and the method of using a regeneration solution to produce a regenerated solder stripper solution capable of commercial use in immersion or spray solder stripping processes.

DESCRIPTION OF THE PREFERRED EMBODIMENTS

The basic method of the invention is the use of sulfate or bisulfate salts to precipitate lead salts for removal from spent ferric nitrate containing solder strippers, allowing effective regeneration and reuse of the solder strippers. The regeneration solution can be a separate solution from the source of sulfate or bisulfate salts, or the regeneration solution and the sulfate/bisulfate salts may be combined in one system. The lead precipitation solution must contain, at a minimum, a source of sulfate or bisulfate ions. Sulfuric acid is a convenient and simple source to use. Other possible sources are sodium sulfate, sodium bisulfate, potassium sulfate, potassium bisulfate, ammonium sulfate, ammonium bisulfate, magnesium sulfate, ferrous sulfate, ferric sulfate, or any other compounds which react to release sulfate or bisulfate in acidic solution. The regeneration solution may contain one or more of the above listed sources of sulfate, or it may be sulfate-free. The regeneration solution may contain one or more of the following materials: nitric or methylsulfonic acid; a source of ferric ions, typically ferric nitrate; chloride ions; an effective amount of triazole corrosion inhibitors; and an effective amount of a nitrogen oxide fume inhibitor such as sulfamic acid. The combination of these constituents is dependent upon the actual starting solder stripper and the effective range of its components, so no specific amounts of replenisher components are listed here. Formulation of an effective replenisher solution is well understood and relatively simple.

The following is considered to be a brief summary of the processes occurring during stripping of solder such as 60:40 weight per cent tin:lead solder. During operation of the stripper, the nitric acid dissolves the solder and tin by a oxidizing the lead and tin of the solder, and forming water soluble nitrate salts. Ferric ions such as from ferric nitrate are an effective oxidizing agent for many metals and additionally help to dissolve the solder, while becoming reduced to inactive ferrous ions. "Spent" solder strippers can be to some extent reactivated by allowing the ferrous ions to reoxidize back to ferric ions, by exposure to air, oxygen, or hydrogen peroxide. High concentrations of nitric acid can passivate metals such as tin by a poorly understood process involving formation of an insoluble oxide layer. Chloride ions help to dissolve the tin by forming soluble tin chloride salts, but too much chloride can give an insoluble oxychloride surface layer on the tin. Methylsulfonic acid may be used in place of nitric acid, to promote the oxidizing effect of ferric salts such as ferric nitrate.

Some of the tin of the solder reacts to form an alloy with the underlying copper, which is less easily dissolved than either tin, lead, or their mixture. The ferric ions function as a stronger oxidizing agent than nitric acid or methylsulfonic acid to dissolve this tin-copper alloy and to expose the pure copper of the film.

A large range of variation of each of these components is possible while still achieving effective precipitation of lead salts. The proportions set out in Table I illustrate one of the compositions and ranges which will produce acceptable lead precipitation and regeneration. Other suitable compositions are described in the patents previously mentioned.

The stripping of the solder from the boards is done either by a dip tank or by transport by a conveyor system through a spray booth. Both such systems are in such common use as to require no further explanation. Insoluble sludges containing much of the tin in the form of tin metastannate must be periodically removed as they accumulate. These tin sludges may be removed in combination with the lead precipitates, but no specific additives are needed for the tin.

Nitric acid is commercially available as a wide range of compositions, but commonly as a nominally 70% by weight solution. Methylsulfonic acid is also commercially available as a nominal 70% by weight solution. Ferric nitrate is most economically available as an aqueous solution containing 45% by weight of anhydrous ferric nitrate. Other effective soluble ferric salts or ferric solutions may be substituted for the ferric nitrate within the limits of the formulation.

Chloride ions may be obtained from ferric chloride, hydrochloric acid, or ammonium chloride. Many types of triazole compounds are commercially utilized as soluble copper corrosion inhibitors and brighteners. Any acid soluble compound or suitable salt may be used, alone or in combination. Typical triazoles include benzotriazole, tolyltriazole, and carboxybenzotriazole.

It will be recognized by those skilled in the art that many combinations of chemicals and different forms of chemicals, such as anhydrous salts, may be used to give identical aqueous solutions. Further, the ranges of chemical concentrations may be separately adjusted within these ranges to give many effective liquid compositions.

Tests were conducted by immersing samples of solder plated and tin plated copper clad printed circuit boards in model or commercial solder strippers to exhaust the baths and load them with dissolved solder. The nominal solder thickness was 0.0003 inches and the nominal composition was 60:40 weight percent tin:lead. Test panels were 2.54× 3.8 cm, coated on one side only.

The stripping effectiveness after regeneration was determined by measuring the time needed to strip each panel immersed in a 100 ml portion of the stripping solution at room temperature without agitation. Lead before and after precipitation was analyzed by atomic absorption spectroscopy. The copper appearance was noted after rinsing, by evaluating both the shininess and the amount of water beading on the surface. A large amount of water beading correlated with good copper corrosion inhibition and is highly desirable.

The basic formula for the solder stripper used in most of the Examples is shown in Table I and was used for all tests except as noted. Tests were run with the following materials: sulfuric acid, ammonium sulfate, ammonium dihydrogen phosphate, sodium sulfate, potassium pyrophosphate, potassium metaphosphate, sodium tetraborate, and several organic acids. The solutions were allowed to stand overnight and then filtered for examination. Sulfates were the most effective compounds for precipitating lead. Filtration was relatively difficult, the lead sulfates being fine and slow to settle. Many methods were tried, including aging, boiling, addition of diatomaceous earth filter aid, and addition of both anionic and cationic flocculating agents. The residual lead concentration showed much variability. Typically the lead could be reduced to between 8 g/l and 0.065 g/l from an initial lead concentration of 35 g/l. Much of the variability was due to the difficulty in filtration of the very fine lead sulfate/bisulfate particles.

Filtration was much easier in the very low pH, used solution containing all of the nitric acid. The residual lead concentration was as low as 0.87 to 0.0625 g/l from an initial lead concentration of 29.5 g/l. This solution gave greater amounts of lead removal, even though the solution was highly acidic. The solubility tables indicated that lead sulfate is slightly soluble in acidic solution, so this result was totally unexpected. Poorer results were obtained with ammonium sulfate than with sulfuric acid, in both tests. There was much variability in the ease of lead precipitation and filtration when commercial solder strippers of unknown detailed composition were tested, but all commercial ferric nitrate based solder strippers worked satisfactorily with sulfate additions to precipitate lead salts.

TABLE I

BASIC MODEL SOLDER STRIPPER

| CONCENTRATION, g/l | CHEMICAL |
|---|---|
| 400 | 70% nitric acid |
| 150 | 45% ferric nitrate |
| 25 | ammonium chloride |

TABLE I-continued

| BASIC MODEL SOLDER STRIPPER | |
|---|---|
| CONCENTRATION, g/l | CHEMICAL |
| 1 | gluconic acid |
| 10 | benzotriazole |
| 15 | tolytriazole |

EXAMPLE I

The model solder stripper solution was loaded with 100 g/l of solder by stripping of solder coated test panels. The resulting lead content was 35 g/l, or 0.168 M/l. Another portion of the model solder stripper solution was not loaded with solder. Sulfuric acid in a 1:1 sulfate:lead mole ratio was added to each of the strippers. Due to delayed precipitation of lead, the "used" solution was filtered several times. The filtered "used" solution contained 12.2 g/l lead. The "unused" solution had no precipitation, as expected. The precipitate was expected to be a mixture of lead bisulfate and lead sulfate.

Benzonitrile is a copper corrosion protection compound. Tests showed that extra benzonitrile was the minimum chemical addition necessary to give a good copper appearance when the used stripper was reused. Separate tests on "unused" solder stripper showed that excess benzonitrile was not detrimental to the performance. Thus the differences between the "used" and "unused" baths can be related to the amount of free sulfate left in the bath. All of the added sulfate was present in the "unused" bath, while only a fraction of the added sulfate was present in the "used" bath.

To each bath was added 10 g/l of benzotriazole. Strip time was 110–120 seconds for each, with the "unused" model stripper being slightly faster. However, the "used" stripper gave a somewhat brighter, more uniform appearance. The "unused" model stripper control showed that large amounts of free sulfate give a dull, mottled copper surface, with the appearance worsening with increasing sulfate. Also, total lead removal is not necessary for effective reuse and regeneration of the solder stripper.

EXAMPLE II

The work in Example I was repeated, using an addition of sulfuric acid in a 1:5 sulfate:lead mole ratio added to each of the strippers. Due to delayed precipitation of lead, the used solution was filtered several times. The filtered used solution contained 7.9 g/l lead.

To each bath was added 10 g/l of benzotriazole. Stripping took 90–130 seconds in the model solder stripper and 105–110 seconds in the regenerated stripper. Appearance was excellent for both.

EXAMPLE III

The work in Example I was repeated, using an addition of ammonium sulfate in a 1:1 sulfate:lead mole ratio added to each of the strippers. Due to delayed precipitation of lead, the used solution was filtered several times. The filtered used solution contained 22 g/l lead.

To each bath was added 10 g/l of benzotriazole. Stripping took 100–105 seconds for the control. The regenerated stripper took 180– 210 seconds. The model stripper was perfect; the regenerated stripper showed some small copper oxidation spots. The ammonium sulfate was still slowly precipitating lead sulfate when this test was run. The addition of commercial flocculating agents would be expected to increase the rate of precipitation of lead sulfate.

EXAMPLE IV

A comparison test was made on a low acidity solder stripper. The used solution was distilled to remove all of the nitric acid, then the same volume of water was added. This ensured that only sulfuric acid was present, to maximize the amount of sulfate ion present relative to bisulfate ion.

The model solder stripper was loaded with 250 g/l of solder for these tests. Analysis showed the lead concentration to be 96.5 g/l (0.46 M). To 100 ml of solution was added 2.4 ml of 98% sulfuric acid. After the addition, the solution was allowed to stand for 30 minutes to allow precipitates to settle, then the liquid was filtered and tested. The lead decreased to 29 g/l. The solution was then distilled to remove free nitric acid, giving 62 ml of distillate. After the distillation, the residue was treated with 62 ml of distilled water and allowed to settle. The solution was filtered again and analyzed. The final concentration after redissolution in water was 18.3 g/l (0.088 M). The amount of sulfuric acid added was 0.41 M/l, about 10% less than the theoretical minimum amount. The sulfuric acid was (0.46–0.0880/0.41= 90.7% efficient in precipitating the lead, as expected for lead sulfate precipitation.

EXAMPLE V

A sample of commercial spent solder stripper (Micelle Corp, #) from a printed circuit facility was tested with additions of sulfate. No precipitate was initially visible. This is known as a "non-sludging" type of solder stripper, as undesirable solids do not form during solder stripping. The used stripper had 29.5 g/l of dissolved lead (0.1418 M), which is equivalent to stripping 73.75 g/l of 60:40 tin:lead solder (0.61 lbs of solder per gallon).

Different amounts of sulfuric acid were added to identical volumes of the same commercial spent solder stripper, as shown in Table I. 50 ml aliquots of solder stripper were used. After standing for a few hours, the murky solutions began to clear and to precipitate a white solid. Analysis of the clear liquids after filtration are shown in Table II. Lead reductions of up to 99.79% were achieved.

TABLE II

| LEAD PRECIPITATION BY SULFURIC ACID | | | | |
|---|---|---|---|---|
| # | ml $H_2SO_4$ | Ratio $SO_4^{2-}$:Pb | Residual Pb | % Pb Removal |
| 1 | 1 | 2.5:1 | 0.87 g | 97.05 |
| 2 | 2 | 5:1 | 0.42 g | 98.58 |
| 3 | 5 | 12.5:1 | 0.162 g | 99.45 |
| 4 | 10 | 25:1 | 0.0625 g | 99.79 |

This data showed that lead removal is simple even from a "sludgeless" bath which is designed to keep lead in solution. The point of diminishing returns is soon reached, as Table II shows. Almost all of the lead was removed for practical purposes of solder stripper regeneration, by addition of as little as 2% by volume of sulfuric acid. This was an excess of 2.5 moles of sulfate per mole of lead, corresponding closely to the precipitation of lead bisulfate. Even lesser amounts should be usable in a commercial process, as complete removal for practical stripper regeneration is unnecessary.

EXAMPLE VI

The solder stripper solution consisted of a mixture of 500 ml/l of 70% methylsulfonic acid and 150 g/l of ferric nitrate 9-hydrate. The solution was used to strip 60/40 tin-lead solder from copper printed circuit boards until the stripping rate was less than 1.5 minutes for complete removal. The lead concentration was now 16 g/l. The solution was divided into 100 ml portions. To one portion was added 1.63 g of 96% sulfuric acid, comprising a 1:1 molar ratio of sulfate to lead. To the other portion was added 3.25 g of 96% sulfuric acid, comprising a 2:1 molar ratio of sulfate to lead. The solutions were allowed to stand 48 hrs to allow the lead sulfate to settle before filtering. The filtered solutions contained 0.2 g/l lead for the 1:1 mole ratio addition and 0.0298 g/l lead for the 2:1 mole ratio addition.

EXAMPLE VII

The two solutions of Example VI were filtered to remove lead sulfate and insoluble tin compounds. To 100 ml of each solution was added 20 ml of a replenishment solution. The replenishment solution consisted of 100 ml/l of 70% methylsulfonic acid, 100 ml/l of 45% ferric nitrate solution, 2 g/l of benzotriazole, and 1 g/l of tolytriazole.

Solder coated printed circuit board test panels were immersed in each solution. Stripping time and appearance was acceptable in the 1:1 mole ratio solution. The 2:1 solution gave a stripping time of greater than 10 minutes, showing that excess sulfate interferes with effective stripping.

We claim:

1. A method and process for purifying used ferric nitrate based solder stripper compositions containing lead for reuse, without pH neutralization, comprising addition of sulfate ions, removal of insoluble lead compounds, and addition of replenisher solution sufficient to restore the solder stripping ability of the solder stripper.

2. A method as defined in claim 1 wherein the source of said sulfate ions is selected from the group comprising sulfuric acid, inorganic sulfate salts, organic sulfate salts, and partially neutralized bisulfate salts.

3. A method as defined in claim 1 wherein said addition of said sulfate ions comprises addition of a liquid source of sulfate.

4. A method as defined in claim 1 wherein said addition of said sulfate ions comprises addition of a solid source of sulfate.

5. A method as defined in claim 2 wherein said partially neutralized bisulfate salts is selected from the group comprising ammonium bisulfate, sodium bisulfate, and potassium bisulfate.

6. A process as defined in claim 1 wherein said replenisher solution contains an acid selected from the group comprising of nitric acid, methylsulfonic acid, and mixtures thereof.

7. A process as defined in claim 1 wherein said replenisher solution contains a ferric salt.

8. A process as defined in claim 7 wherein said source of ferric ions is selected from the group consisting of ferric nitrate, ferric chloride, ferric acetate, ferric lactate, ferric ammonium sulfate, ferric ammonium chloride, ferric citrate, ferric hydroxide, ferric oxide, and non-sulfur bearing water soluble ferric salts of organic and inorganic nature.

9. A process as defined in claim 1 wherein said replenisher solution contains a copper corrosion inhibitor selected from the group consisting of benzotriazole, tolytriazole and combinations thereof.

10. A process as defined in claim 1 wherein said sulfate ions are added in a molar amount equal to 0.5 to 25 times the concentration of lead in said used ferric nitrate based solder stripper composition.

11. A process as defined in claim 10 wherein said sulfate ions are added in a molar amount equal to 1 to 5 times the concentration of said lead.

* * * * *